US009353595B2

(12) United States Patent
Duncan et al.

(10) Patent No.: US 9,353,595 B2
(45) Date of Patent: May 31, 2016

(54) METHOD AND SYSTEM FOR CONTAINING UNCONTROLLED FLOW OF RESERVOIR FLUIDS INTO THE ENVIRONMENT

(71) Applicant: General Marine Contractors LLC, Houston, TX (US)

(72) Inventors: Iain Duncan, Houston, TX (US); Martin Davidson, Houston, TX (US)

(73) Assignee: GENERAL MARINE CONTRACTORS LLC, Houston, TX (US)

( * ) Notice: Subject to any disclaimer, the term of this patent is extended or adjusted under 35 U.S.C. 154(b) by 0 days.

(21) Appl. No.: 14/456,618

(22) Filed: Aug. 11, 2014

(65) Prior Publication Data

US 2015/0027719 A1 Jan. 29, 2015

Related U.S. Application Data

(63) Continuation of application No. 13/115,794, filed on May 25, 2011, now Pat. No. 8,833,464.

(60) Provisional application No. 61/374,836, filed on Aug. 18, 2010, provisional application No. 61/348,719, filed on May 26, 2010.

(51) Int. Cl.
*E21B 29/12* (2006.01)
*E21B 29/00* (2006.01)
(Continued)

(52) U.S. Cl.
CPC ..... *E21B 33/076* (2013.01); *E21B 21/106* (2013.01); *E21B 29/08* (2013.01); *E21B 29/12* (2013.01); *E21B 33/064* (2013.01); *E21B 47/06* (2013.01); *E21B 2034/002* (2013.01)

(58) Field of Classification Search
CPC ..... E21B 29/08; E21B 29/12; E21B 33/064; E21B 33/076; E21B 43/0122
USPC ..... 166/335, 337, 344, 350, 351, 356, 363, 166/364, 361, 297, 298
See application file for complete search history.

(56) References Cited

U.S. PATENT DOCUMENTS 2,000,381 A 5/1935 Duffy
2,840,166 A * 6/1958 Eckel et al. ..... 166/55
(Continued)

FOREIGN PATENT DOCUMENTS

JP 6015012 1/1994
WO WO/2009/154901 12/2009

OTHER PUBLICATIONS

Search Report and Written Oinion in International Application No. PCT/US2011/038182 mailed Sep. 22, 2011.
(Continued)

*Primary Examiner* — James G Sayre
(74) *Attorney, Agent, or Firm* — Norton Rose Fulbright US LLP

(57) ABSTRACT

Systems and methods for quick access and control of a blown-out well or well that is flowing uncontrollably into the environment. Preferred embodiments of the present invention provide a re-entry of the casing of the blown-out well below the mud line and the inoperable blowout preventer. The present invention also provides a method to re-enter a production, or injection well, either subsea below the mud line or above the mud line for surface facility applications. According to a preferred embodiment of the present invention, a miniature wellbore is created from the outer casing through the various smaller casing strings into the final wellbore to protect the structural integrity of the well. Once the casing is safely penetrated, coil tubing and or kill weight fluid can be introduced to stop the uncontrolled flow of reservoir fluid. The well can then be sealed with cement and abandoned as normal practice dictates.

23 Claims, 9 Drawing Sheets

(51) Int. Cl.

| | |
|---|---|
| ***E21B 33/076*** | (2006.01) |
| ***E21B 21/10*** | (2006.01) |
| ***E21B 29/08*** | (2006.01) |
| ***E21B 33/064*** | (2006.01) |
| ***E21B 47/06*** | (2012.01) |
| *E21B 34/00* | (2006.01) |

(56) References Cited

U.S. PATENT DOCUMENTS

| | | | | | |
|---|---|---|---|---|---|
| 2,889,885 | A | | 6/1959 | Hildebrandt | |
| 2,924,130 | A | | 2/1960 | Reynolds | |
| 3,738,424 | A | * | 6/1973 | Osmun et al. | 166/298 |
| 3,771,601 | A | * | 11/1973 | Garrett | 166/297 |
| 4,336,843 | A | | 6/1982 | Petty | 166/353 |
| 4,505,751 | A | | 3/1985 | Sydansk | 166/282 |
| 5,791,409 | A | | 8/1998 | Flanders | 166/55.8 |
| 5,931,442 | A | | 8/1999 | Cummins | 251/1.1 |
| 6,012,878 | A | | 1/2000 | Hicks | 408/1 R |
| 6,179,057 | B1 | * | 1/2001 | Fontana et al. | 166/363 |
| 6,200,068 | B1 | * | 3/2001 | Bath et al. | 405/184.1 |
| 6,347,666 | B1 | | 2/2002 | Langseth | 166/252.1 |
| 7,722,298 | B2 | | 5/2010 | Russell | 408/1 R |
| 2007/0104547 | A1 | | 5/2007 | Russell | 408/1 R |
| 2009/0063055 | A1 | * | 3/2009 | Schneider et al. | 702/9 |
| 2009/0260695 | A1 | * | 10/2009 | France et al. | 137/318 |
| 2010/0212754 | A1 | | 8/2010 | Ayers et al. | 137/318 |
| 2010/0229958 | A1 | | 9/2010 | Puckett et al. | 137/15.12 |
| 2010/0278602 | A1 | | 11/2010 | Clark et al. | 408/115 R |
| 2011/0307105 | A1 | * | 12/2011 | Commoner | 700/282 |

OTHER PUBLICATIONS

International Preliminary Report on Patentability in International Application No. PCT/US2011/038182 mailed Nov. 27, 2013.

Office Action in U.S. Appl. No. 13/115,794 dated Jan. 8, 2013.

Notice of Allowance in U.S. Appl. No. 13/115,794 dated May 6, 2014.

Office Action in Russian patent application No. 2012156898 dated Mar. 30, 2015.

Decision of Grant in Russian patent application No. 2012156898 dated Oct. 21, 2015.

* cited by examiner

METHOD AND SYSTEM FOR CONTAINING UNCONTROLLED FLOW OF RESERVOIR FLUIDS INTO THE ENVIRONMENT

CROSS-REFERENCE TO RELATED APPLICATIONS

This application is a continuation of U.S. patent application Ser. No. 13/115,794 filed on May 25, 2011, which claims priority to: U.S. Provisional Applications No. 61/374,836, filed on Aug. 18, 2010, and No. 61/348,719, filed on May 26, 2010, all of which disclosures are incorporated herein by reference in their entireties.

FIELD OF THE INVENTION

The present invention generally relates to subsea oilfield well operations and more particularly to a system and a method for accessing a well and containing uncontrolled flow of reservoir fluids into the environment.

BACKGROUND

Subsea well drilling and production are complex and dangerous operations. One such danger is a blowout of the well. A blowout is the uncontrolled release of crude oil and/or natural gas (hydrocarbon) from an oil well when formation pressure exceeds the pressure applied to it by the column of drilling fluid. Typically, a blowout occurs as a result of pressure control systems failure, or loss of containment, of a surface well due to natural disaster or other event.

A conventional well includes an array of equipment designed and operated to prevent blowouts. One example of such equipment is a blowout preventer (BOP). Generally, the first line of defense in well control is to properly maintain the balance of mud in the wells circulatory system to ensure that the hydrostatic weight, or pressure from the drilling fluid is equal or slightly greater than the pressure from the formation. When control of the formation pressure is not possible, the conventional second line of defense is the blowout preventer, which is part of the well. The BOP is a large set of valves that is connected to the wellhead. Further, the BOP can be operated remotely from the surface and is used in everyday drilling activities. The BOP can be closed in the event that control of the formation pressure is lost, and the well starts to flow uncontrollably.

Despite the wealth of conventional equipment, a blowout that disables or destroys well control equipment and facilities, particularly, equipment that disables the blowout preventer, production equipment, and associated systems, can result in substantial loss of oil and gas from the uncontrolled well and immeasurable environmental damage. In such emergency situations, well operators are left with few options, most of which are more theoretical than true and tested. As demonstrated by the British Petroleum blowout in the Gulf of Mexico (GOM), the options were either unrealistic, or when tried, ineffective.

One realistic option is the drilling of a relief well, which is a directional well that is drilled to intersect a well that is blowing out. The relief well is used to kill the uncontrolled well by injecting sufficient drilling fluid to drive back the flow of reservoir fluid. Drilling the relief well, however, is time-consuming, often requiring numerous weeks or months at a time where every minute of unabated oil and gas flow is costly and environmentally harmful.

In light of the above, there is a need for a faster, safer and more sure approach to access, control, and subsequently kill a blown-out, uncontrolled well that does not require a well's subsea or surface equipment to be operable after the blow out.

SUMMARY OF THE INVENTION

The present disclosure provides a method and system for promptly containing the well without the reliance on existing installed well equipment. Generally, the embodiments of the present disclosure create a miniature wellbore from the outer casing string through the various smaller casing strings into the final wellbore.

One objective of the present disclosure is to provide systems and methods for re-entry of any subsea well at any pressure or temperature condition, irrespective of water depth.

Another objective of the present disclosure is to provide a system that is completely operated remotely, that can be installed and left as part of the initial well configuration as a final safety device when all other conventional systems have failed.

A further objective of the present disclosure is to provide systems and methods for re-entry of any well below the mud line, through multiple conductor/casing strings to confirm the wells integrity between each respective string in a diagnostic investigation of the status of the well.

Another objective of the present disclosure is to provide a method of introducing coil tubing and tools into a wellbore from below the mud line.

Yet another objective of the present disclosure is to provide systems and methods for containment of a well that has a blowout where other primary methods of containment have failed.

One other objective of the present disclosure is to provide systems and methods that enable the access of a well bore of a damaged surface facility where the well has suffered loss of containment due to a natural disaster, or other catastrophic events, where the invention can be used below the mud line or above the mud line by attachment to a drilling or production riser.

Still another object of the present disclosure is to provide systems and methods that enable hot tapping of a live well through multiple pipes, to access the well bore to enable the well outside conventional methods of well entry, for the purposes of service of abandonment.

To meet the above objectives, there is provided, in accordance with one aspect of the present disclosure, a method for accessing and controlling fluid flow through a subsea well conduit below the sea floor. The method comprises the steps of enclosing at least a portion of a conduit comprising at least two pipes with a containment system having a containment shell, wherein the conduit is located below the sea floor and is experiencing or threatening to experience uncontrolled fluid flow through the conduit; sealing the containment shell about the conduit to form a pressure barrier between the pressure external to the containment shell and the pressure of the interior of the containment shell; engaging a first pipe of the conduit with a first sleeve; extending the first sleeve between the first pipe and a second pipe positioned within the first pipe; creating a pressure seal between the first sleeve and the first pipe; penetrating said first pipe of said conduit with a penetration device that is part of said containment system; and introducing coil tubing or fluid through the containment system into the interior of the conduit sufficient to control said fluid flow.

In a preferred embodiment, the penetrating step is performed by mechanically cutting through the first pipe, where the means to accomplish the mechanical cutting is selected from a group consisting of grinding, drilling, water jetting, and milling.

In yet another preferred embodiment, the method includes monitoring the pressure of the fluid flow to determine the angle, velocity, and pressure at which to introduce the coil tubing or fluid into the interior of the conduit.

In accordance with another aspect of the present disclosure, there is provided a system for accessing and controlling fluid flow through a subsea well conduit below the sea floor. This system comprises a containment shell configured to enclose at least a portion of a conduit comprising at least two pipes, where the conduit is located below the sea floor and is experiencing uncontrolled fluid flow through the conduit; a first fluid line to deliver sealant to the containment shell to form a pressure barrier between the pressure external to the containment shell and the pressure of the interior of the containment shell; a penetration device configured to penetrate a first pipe of the conduit, wherein the penetration device comprises a first sleeve configured to mechanically cut through the first pipe; sealing means to attach the sleeve to said conduit, wherein the first sleeve extends between the first pipe and a second pipe and at least a portion of the second pipe is within the first pipe; and a second fluid line configured to introduce coil tubing or fluid through the penetration device into the interior of the conduit sufficient to control said fluid flow.

In an alternative embodiment, the system is used to access and control fluid flow through a subsea production or drilling riser conduit below the surface of the water.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF PRIOR ART

One conventional method to access a pressurized piping system is hot tapping, which is the process of drilling into a pressurized pipe or vessel, while using special equipment and procedures to ensure that the pressure and fluids are safely contained when access is made. Typical hot tap units are built for surface and onshore work, or for marine applications at shallow sea depths, and can only access single-walled pipes. In such marine applications, divers access the pipe and perform the hot tap of the pipe.

Figure 1:
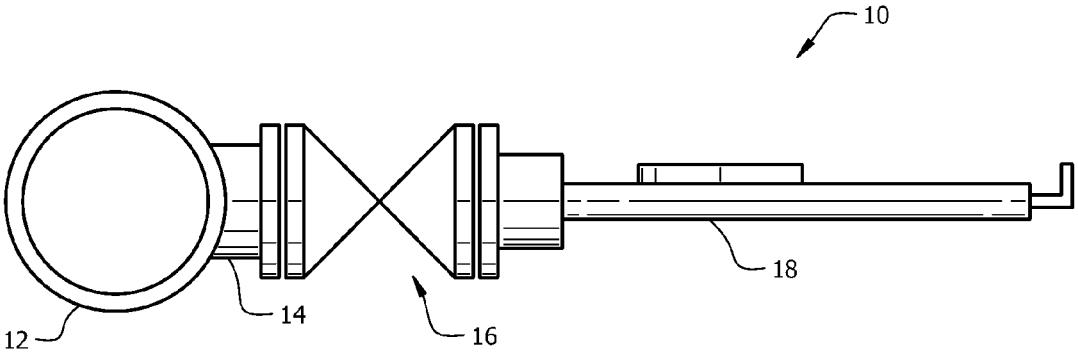
FIG. 1 shows a typical prior art hot tapping system configuration for use in surface or shallow sea operations.
Figures 2A, 2B:
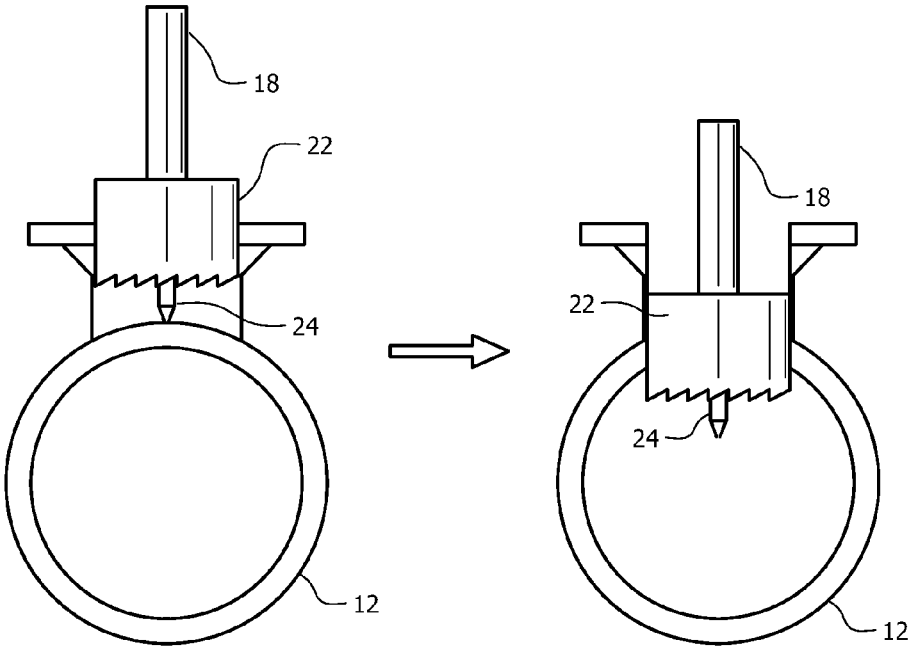
FIG. 2 shows a cross section of the prior art hot tapping system of FIG. 1.

FIG. 1 is an example of a conventional hot taping system, identified generally by the numeral 10. A typical connection of hot tapping system 10 to pipe 12 consists of tapping fitting 14, isolation valve 16, and hot tapping machine 18. Referring to FIGS. 1 and 2, hot tapping machine 18 includes hole saw 22 and wired pilot drill 24, which is located within hole saw 22.

In operation, hole saw 22 is advanced through isolation valve 16 to pipe 12. Hot tapping machine 18 is engaged and the cutting begins. When the cut is finished hot tapping machine 18 is disengaged and retracted beyond the gate of valve 16, which is closed and hot tapping machine 18 can be removed. The cut out portion of pipe 12, also can be called a coupon, is retained by using wired pilot drill 24. The wire on pilot drill 24 toggles to catch the coupon and prevent it from falling off. Currently, most hot tapping systems are equipped to operate at a maximum working pressure of 1500 psi and maximum working temperature of 100° F.

While hot tapping has been used to access pressurized pipelines, the process often requires human operations and only works to access single wall piping at shallow depth above BOP or production tree. The operating conditions and manual operations are rather limiting. As such, conventional hot tapping systems have not been used in offshore high temperature and high pressure environments, such as ones that are involved in subsea well operations. Consequently, conventional hot tapping systems cannot be used to access the casing below the BOP and cannot be employed to access or contain a blown well. Moreover, the piping structure below, as well as above, the mud line contains multiple layers of casing, which conventional hot tapping systems cannot handle.

DETAILED DESCRIPTION OF INVENTION

In contrast to the conventional hot tapping systems described above, the present invention can hot tap a live well, i.e., access the well while reservoir fluid is flowing out of the wellbore below, as well as above, the mud line at significantly greater water depths and higher pressures and temperatures. Further, the present invention allows for hot tapping of multiple-walled conduits, such as the casing strings above or below the high pressure wellhead. In addition, the present invention allows for the introduction of coil tubing, specific coil tubing tools, plugs, adjustable sealing devices, and/or kill weight fluid, sealer, cement, or other material in order to bring the well under control and stop the uncontrolled flow.

Figure 3A:
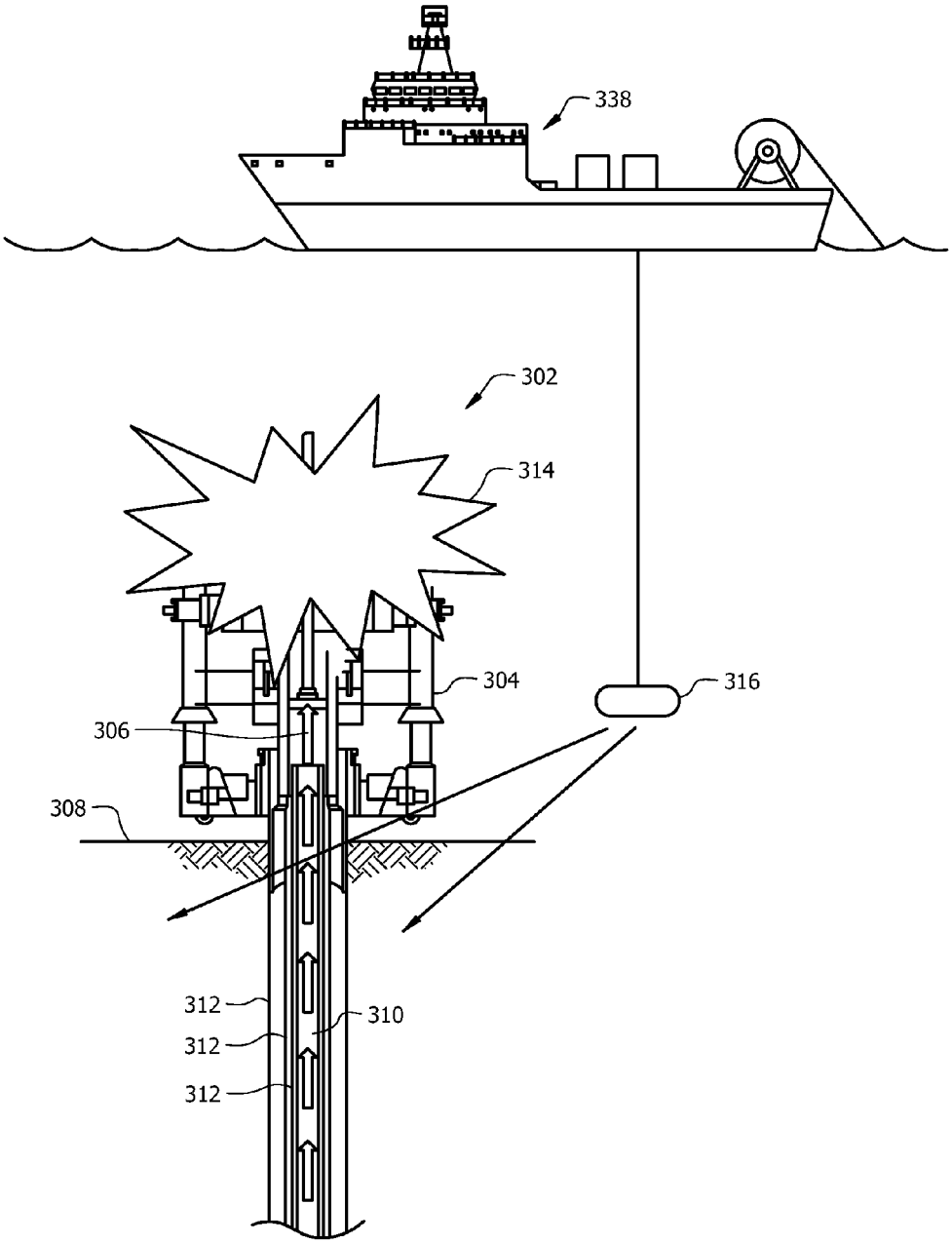
FIGS. 3A-3F show a first embodiment of the present invention.

FIG. 3A shows a conventional subsea well 302, which includes a blowout preventer (BOP) stack 304 connected to a subsea wellhead 306. BOP stack 304 is located on top of the sea floor or mud line 308. As shown, the wellhead 306 provides support for the casing strings 312 that line and support the wellbore 310. As seen, casing 312 comprises multiple intervals of smaller casing strings successively cemented in place within larger ones.

Generally, casing 312 contains the following casing strings, listed from largest to smallest: conductor casing, surface casing, intermediate casing, and production casing. The number of casing strings used in a well varies and depends on the specific requirement of that particular well. The conductor casing serves a number of functions, including serving as structural support of the wellbore and BOP stack, providing wellbore integrity, and ensuring that no hydrocarbon escapes into the environment as reservoir fluids flow to the surface. The conductor casing normally varies in size depending on the well to be drilled. Three typical sizes of conductor casing include thirty-six inch, twenty-six inch, and twenty inch. Pressure containment of the wellbore is typically achieved with the twenty inch conductor casing. As mentioned above, the number and size of the conductor casing used in a well is dependent on the operating conditions and requirements of that well. Typically placed within the twenty inch high pressure casing is the next series of casing strings, which generally include an intermediate strings of sixteen inches, but more typically thirteen and three-eighths inches. The final interval of casing string is the production casing, which is typically nine and five-eighths inches. In certain applications, there can be an additional seven inch casing string. The production casing runs the length of the wellbore into the reservoir.

Casing strings, such as casing 312, are supported by casing hangers that are set in the wellhead, and in specific applications, some intermediate strings can be set in the previous casing below the wellhead. As such, all casing strings of a casing typically hang from the wellhead at or near the sea floor. The length of each casing string varies, beginning with the outermost casing typically having the shortest length and ending with the production casing having the longest length. After each casing string is installed in place, cement is used to fill the cavity between each string and the wellbore to bond the casing to the wellbore and the previous casing string. The cemented casing provides increased containment as the wellbore goes deeper towards the targeted reservoir. The casing strings when cemented in place and hung off in the wellhead provide containment of the formation pressure while drilling and testing activities are conducted. Also, the BOP connected to the wellhead provides a secure entry point to the well and enables active well control during normal drilling practice. When functional, the BOP can be used during production to contain full well pressure and close in the well to circulate out a kick, or contain a unexpected flow of formation fluids entering the wellbore.

Figure 3B:
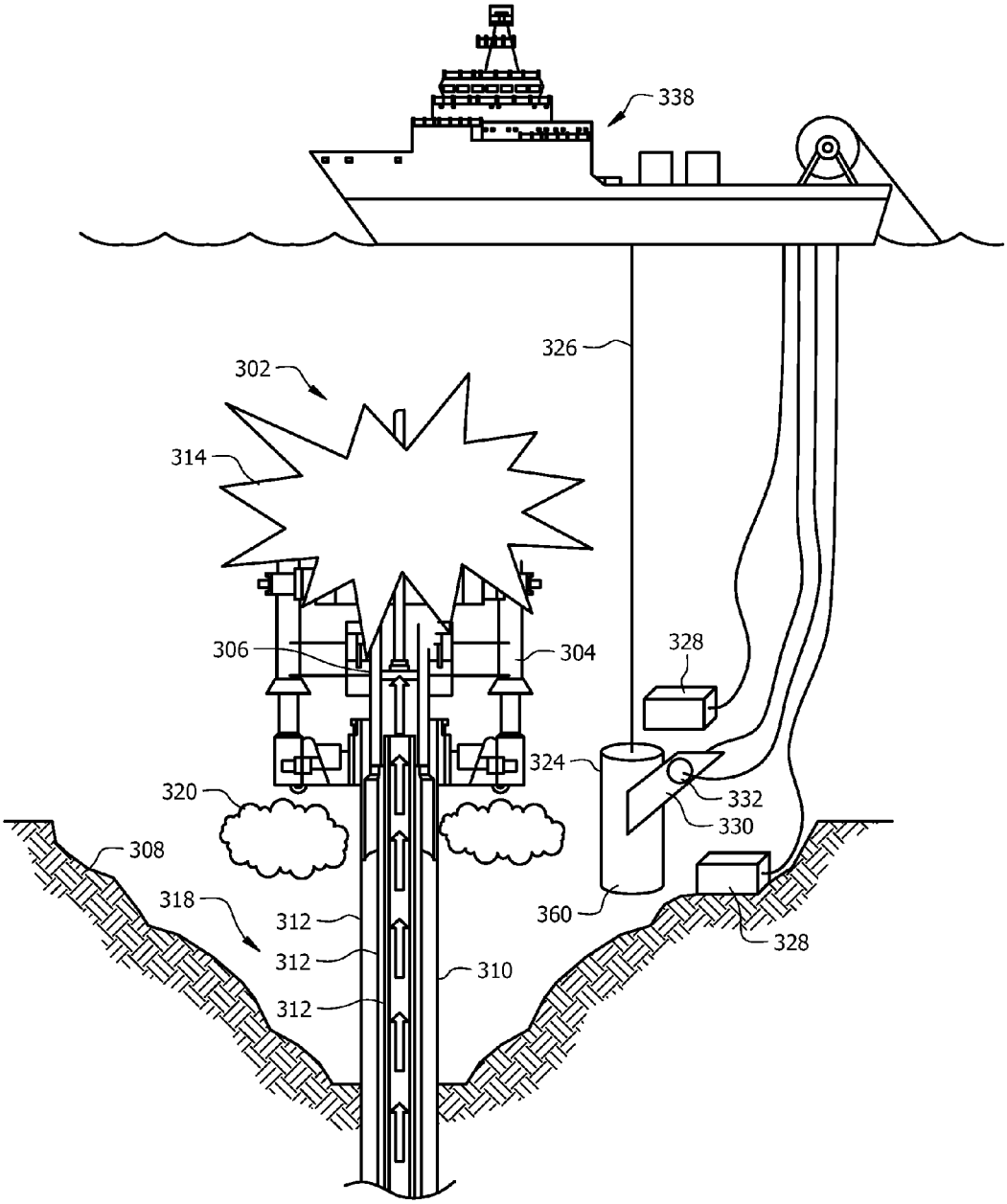

FIGS. 3A and 3B show a blowout 314 at the BOP stack 304, which renders BOP stack 304 inoperable to shut down well 302, thereby allowing hydrocarbon and reservoir fluid to escape into the environment. In such a situation, access to the well is necessary to contain the blowout of hydrocarbons. According to one aspect of the present invention, containment of the uncontrolled flow of reservoir fluid out of wellbore 310 can be achieved by re-entering casing 312 to introduce sufficient kill fluid to stop the flow of reservoir fluids, and bring the well under control. Preferably, the re-entry point is below the sea floor 308 and close to where the inoperable BOP stack 304 and wellhead 306 are located. Accordingly, in some embodiments, it is necessary to excavate the area of the sea floor surrounding the desired re-entry point of casing 312. Referring to FIG. 3B, such an excavation procedure should also consider any cement clusters 320 that formed during installation of casing 312, as described above, and as a result, are now attached to casing 312.

Figure 4:
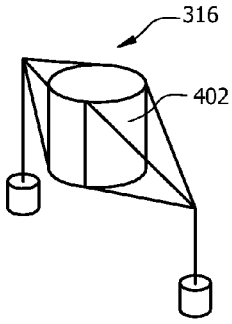
FIG. 4 shows an example of the subsea excavator disclosed in the present invention.

Consequently, to gain access to casing 312 to shut down well 302, the area below BOP stack 304 and cement clusters 320 may need to be sufficiently excavated to expose a clean portion of casing 312. Excavation can be achieved through various means. Preferably, referring to FIGS. 3A and 3B, a subsea excavator 316, which typically uses large propellers that remove mud from the sea floor, is deployed from vessel 338, or other vessels, to excavate the area 318 below BOP stack 304 and cement clusters 320 to expose a clean portion of outer casing 312. In addition, one or more Remote Operated Vehicles (ROVs) can be deployed to clean the area of casing to allow the well containment system 324 to engage the casing 312. FIG. 4 shows an example of the subsea excavator 316 extracting mud from the seafloor having a large propeller 402 to extract particles of the sea floor. While the preferred embodiment employs a subsea excavator, it is envisioned that other embodiments can employ other means to similarly excavate an area sufficient to access and reenter casing 312.

FIG. 3B also shows the deployment of the line emergency well containment system 324 from support vessel 338 via surface load line 326, and one or two remote-operated vehicles (ROV) 328. Containment system 324 preferably has a two-part containment shell 360, which has a split arrangement to allow containment system 324 to enclose around casing 312. As demonstrated by FIG. 5A, in some embodiments, containment system 324 can be deployed within a frame (e.g., frame 502) that acts as the primary guidance and locator to attach the containment system 324 to casing 312. In another embodiment, the deployment frame (e.g., frame 502) can be contained within or placed on a mud mat or other means that enables deployment of the containment system 324 on a skidding mechanism. As such, the containment system 324 can be skidded into its final location without the use of load lines or other guidance. Preferably, containment shell 360 has hydraulic operators (not shown) that are energized to form a pressure barrier between the pressure external to containment system 324 and the pressure inside containment system 324. Other embodiments may employ different means, other than hydraulic operators, to create a similar barrier pressure around casing 312.

Figure 3C:
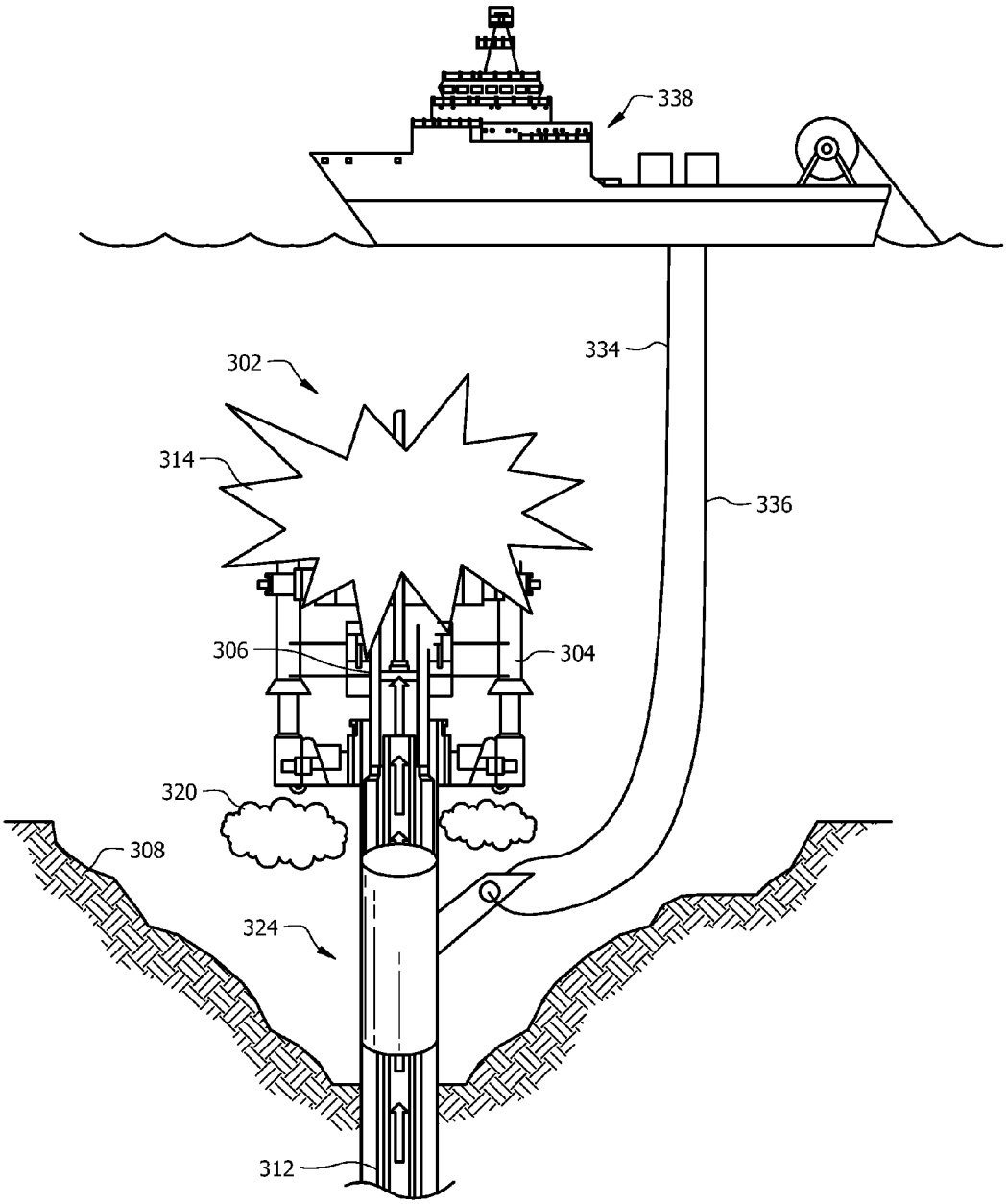

Further, containment system 324 has a perforating assembly 330 that is connected to a dual barrier external port 332. Preferably, perforating assembly 330 is used to penetrate through the casing strings of casing 312. Perforating assembly 330 can achieve the penetration of casing 312 through various means. Hereafter, "perforating" will be used to describe any process used to access the well bore, which can include but are not limited to grinding, drilling, cutting, water jetting, and milling. Other means, however, can be employed to penetrate casing 312. As shown in FIG. 3C, main fluid line 334 and power/fluid supply line 336 are connected to external port 332. In embodiments represented in FIG. 5A, the connection can be via the deployment frame interface 510. In the preferred embodiment, main fluid line 334 can include rigid or flexible high pressure risers. Power/fluid supply line 336 includes lines supplying energy and providing control of containment system 324, as well as delivering various fluids such as sealant, such as epoxy, or lubrication fluid for the cutting process. The main fluid line 334 forms the link between the support vessel 338 and the containment system 324, acting as a conduit to introduce coil tubing and or kill weight fluid. In one embodiment, the coil tubing can be used to introduce complex plugs into the well bore 310 to plug and seal off the flow to facilitate containment activities. Alternatively, other applicable styles of tools can be used to allow the coil tubing to enter the well and proceed to depth to introduce kill weight fluid or well control fluids. The kill weight fluid has physical properties that, once a sufficient amount is injected at the appropriate pressure and flow rate, can stop the uncontrolled flow of reservoir fluid out of well bore 310 and bring the well into a balanced condition. Typically, the exact composition of the kill weight fluid is customized to the conditions of a particular well, e.g., reservoir pressure, density, composition, and flow rate. The other end of lines 334 and 336 are connected to support vessel 338. FIG. 3C also shows the well containment system 324 installed on a clean portion of casing 312.

Figure 3D:
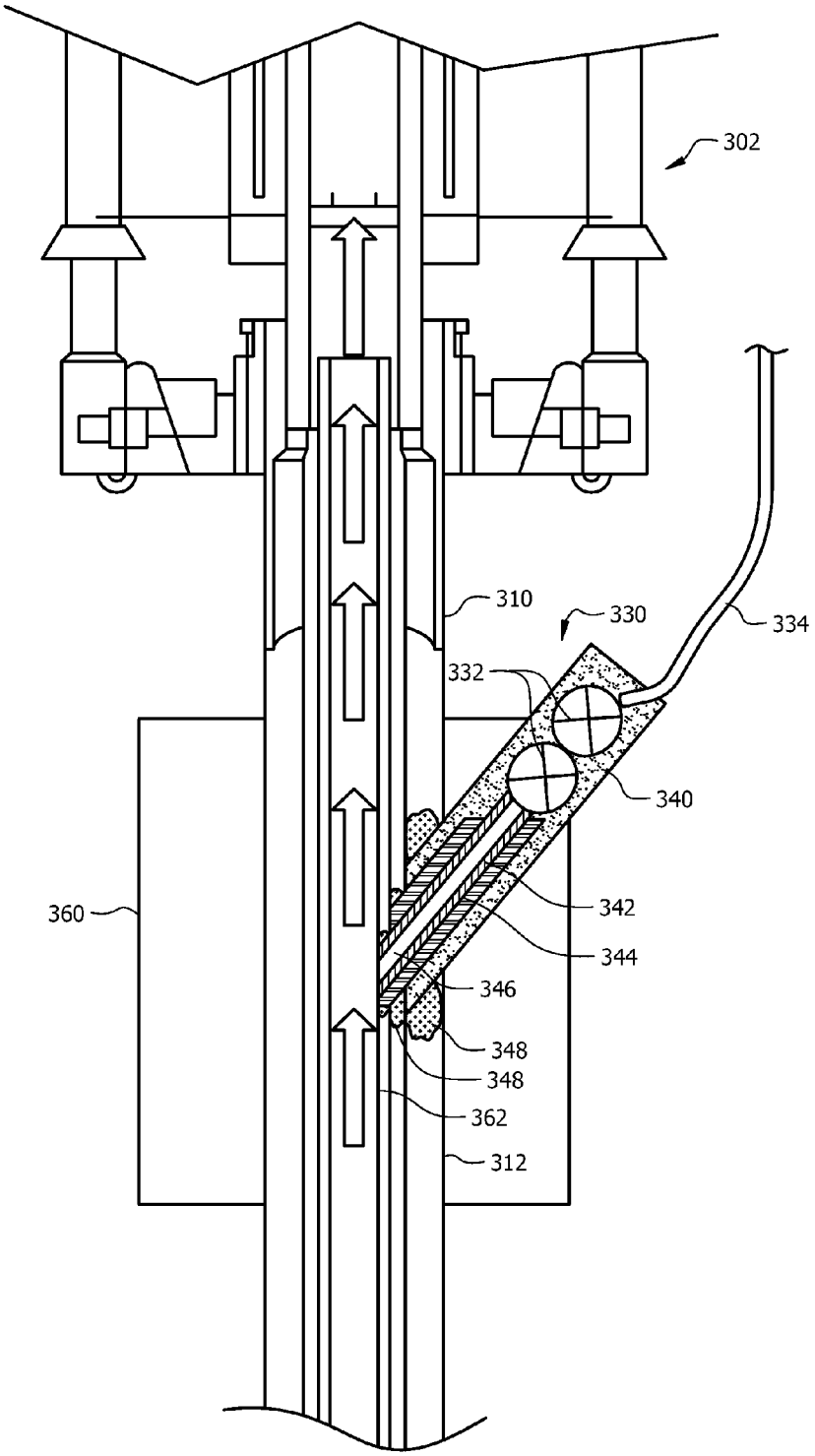
Figure 3E:
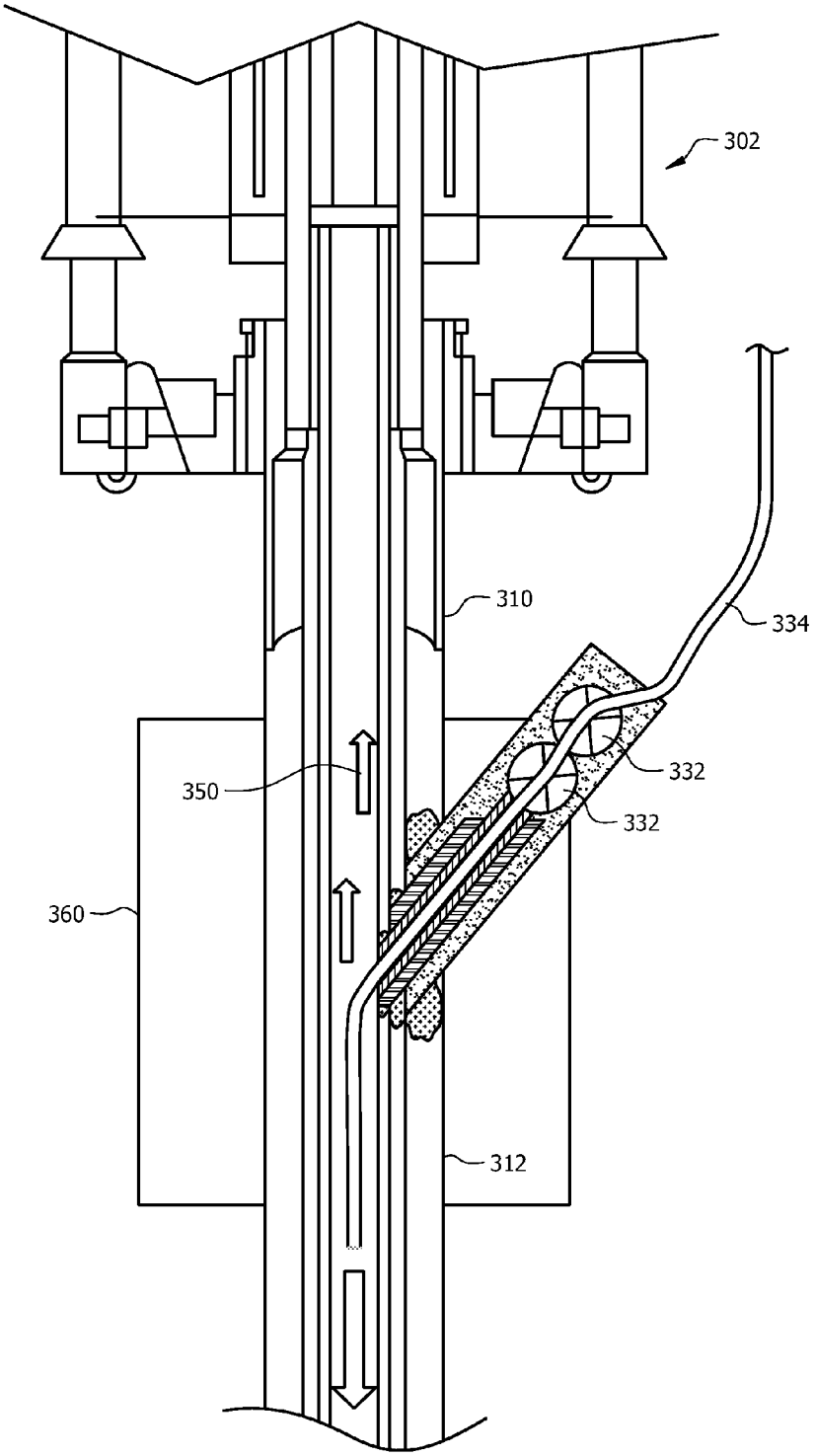
Figure 3F:
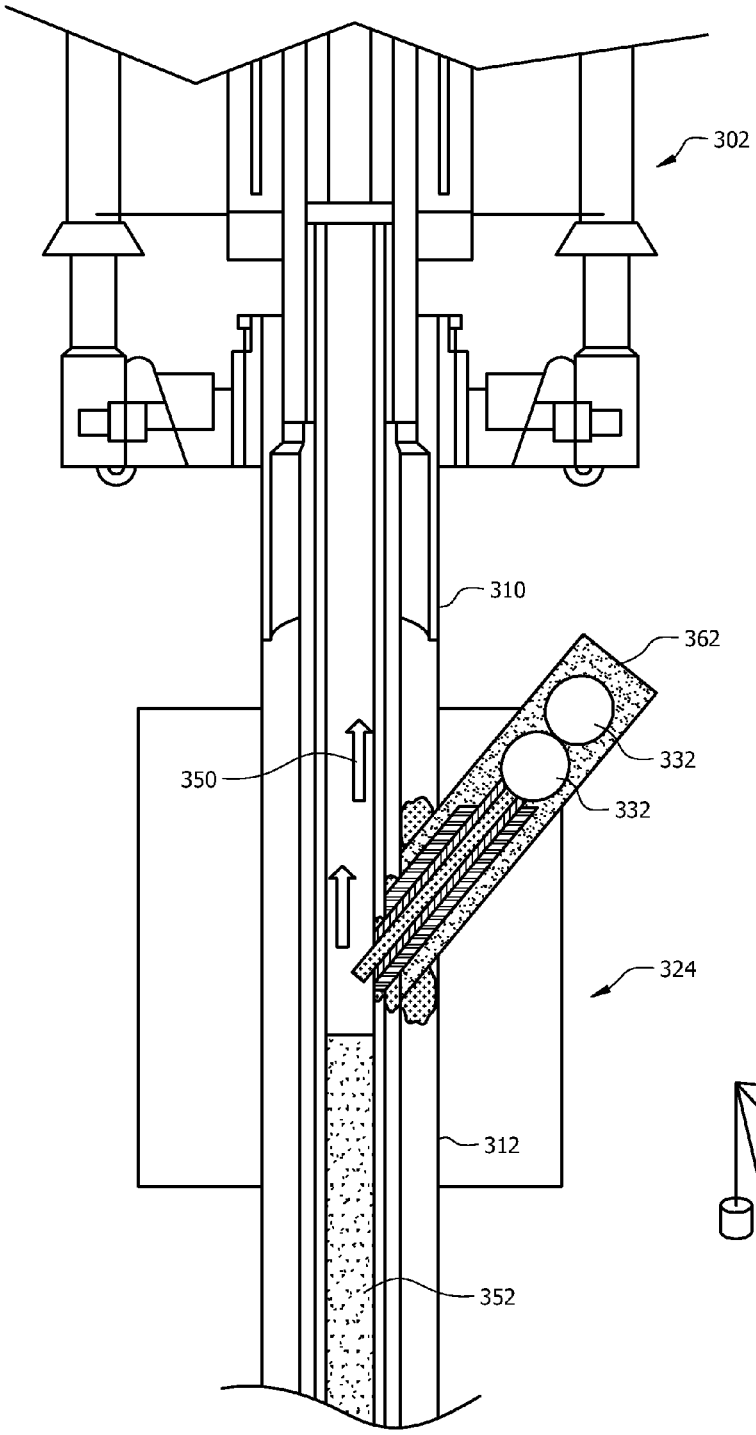

FIGS. 3D, 3E, and 3F present a vertical cross sectional view of containment device 324, which show schematically containment shell 360, perforating assembly 330, and casing 312, which has multiple casing strings as shown. In the preferred embodiment, perforating assembly 330 has pre-sized perforating sleeves 340, 342, 344, and 346 that are designed to conform to the pressure rating of the casing strings as installed in the well 302. That is, the number and size of perforating sleeves 340, 342, 344, and 346 are customized for a particular well depending on the number of casing strings and size of the casing strings installed in that well. The casing information can be obtained from the well log of that specific well. As mentioned above, perforating assembly 330 is connected to external port 332, which comprises of two ball or gate valves in the preferred embodiment. These valves function as a dual barrier that keep the pressure inside perforating assembly 330 isolated from the main fluid line 334 and support vessel 338 (shown in FIGS. 3A-3C). The valves are commercially available and can support various pressures, e.g., up to 20,000 psi. In this embodiment, FIGS. 3D-3F show a typical, ball valve arrangement that has a spherical ball that controls the flow through it. The spherical ball has a hole, or port, through the middle of it so that when the port is in line with both the input and output of the valve, flow will occur through the port. When the valve is closed, the port is perpendicular to the input and output of the valve, and flow is blocked. While ball valves are described herein, other gate valve mechanisms can be used to achieve the same isolation of the pressure inside containment shell 360. Preferably, the valves that form the dual barrier external port 332 have shearing capabilities, thereby allowing the use of coil tubing or other similar equipment with containment system 324.

Perforating assembly 330 also includes redundant hydraulic drive motors (not shown) that are connected to the power/fluid supply line 336. The redundant hydraulic drive motors drive the power head of pre-sized perforating sleeves 340, 342, 344, and 346, as each sleeve mills through its respective casing. While FIGS. 3D, 3E, and 3F show containment system 324 having four perforating sleeves, 340, 342, 344, and 346, the number of perforating sleeves shown is only exemplary and is not intended to be limiting. The number and size of perforating sleeves in containment system 324 are customized to match the casing specification of a well itself. For instance, the number of sleeves is preferably the same as the number of casing strings of the blown-out well, and the size of the perforating sleeve is chosen to conform to the weight bearing properties of the respective casing string. When containment system 324 is deployed, it already contains perforating sleeves customized for that well according to the specifications in the well log of that well. Accordingly, the number and size of perforating sleeves in a containment system varies for each embodiment and depend on the casing specification of the well to which the containment system is installed. Also, in other embodiments, perforating assembly 330 can be configured to engage and rotate multiple sleeves or assemblies at once to cut or mill a pipe or other structure. In particular, the perforating assembly 330 can selectively disengage any or all of the sleeves by remote control of the assembly to isolate one sleeve from its counterpart.

FIG. 3E shows the ball valves of external port 332 open to insert coil tubing and/or inject kill weight fluid from support vessel 338 (shown in FIGS. 3A-3C) through main fluid line 334 and into wellbore 310. Following the introduction of the coil tubing, tools can be deployed to plug and seal off the well bore to enable direct access to the bore if applicable. In another embodiment, kill weight fluid can be introduced to the well to bring it under control via various means, such as coil tubing. The surface vessel 338 (shown in FIGS. 3A-3C) then injects a cement plug to seal off the wellbore. The well is now sufficiently secured that dual barrier external port 332 can be closed, and the connection port 362 capped off. FIG. 3F shows that any removable equipment has been retrieved back to support vessel 338 (shown in FIGS. 3A-3C) and containment system 324 is sealed to provide permanent containment of well 302. As seen, containment system 324 remains permanently attached to casing interval 312 after well 302 is contained. The existing damaged BOP and associated equipment can now be removed, and the well can be capped and protected pursuant to normal drilling practice. Following the safe abandonment of the well the excavated area around the conductor casing 312 can be back filled to complete the operation.

In other embodiments, the containment systems of the present invention can be utilized in the same procedural methodology as detailed above to access a production or drilling riser or conduit above the mud line. For instance, the containment system according to the present invention can be deployed from surface vessels in the same manner and attached to a section of drilling or production riser between the mud line and the surface of the water. In this particular application, it is assumed that loss of containment of the well occurred due to the loss of the surface facility, leaving the high pressure drilling and production risers broken and open to the environment. In this situation, the containment system of the present invention can be deployed at any point where a secure area of riser or conduit is available. Once attached, the containment system would perform the same functions as explain in detail above.

Figure 5A:
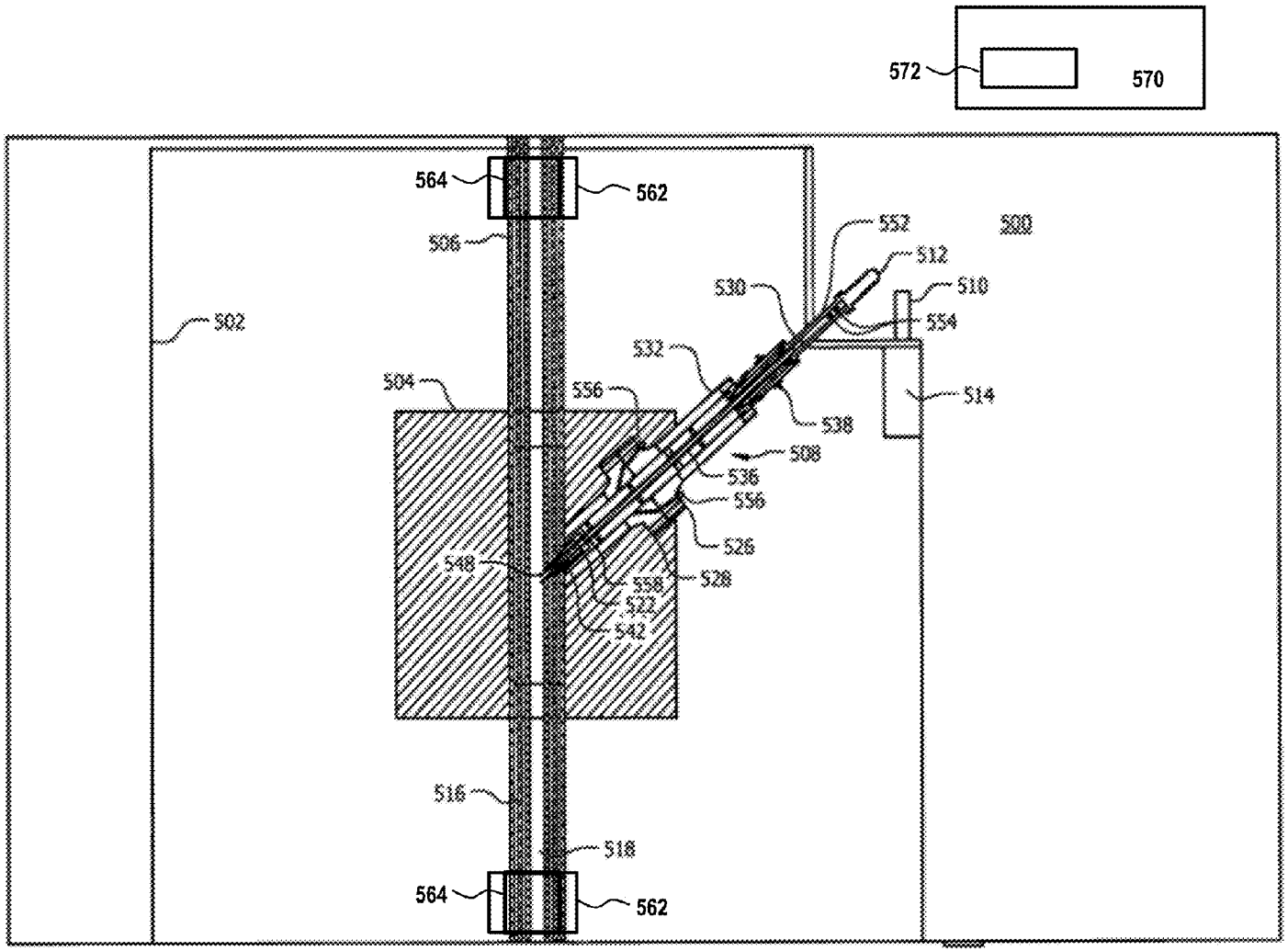
FIG. 5A shows a vertical cross section of a second embodiment of the present invention.

Referring to FIG. 5A, a vertical cross section of containment system 500 is shown. Containment system 500 has a deployment frame 502 that houses the containment shell 504. Deployment frame 502 provides easy access for the ROVs to manage and control the operations of perforating assembly 508. Also, deployment frame 502 provides alignment and structural support for the containment shell 504, the containment shell actuators (not shown) to close and seal the containment shell 504, and perforating assembly 508. Preferably, deployment frame 502 is designed to carry the load of some or all components of containment system 500, including but not limited to, the ROV actuation panel, accumulators, and system interfaces. Perforating assembly 508 is preferably fixed at or around the center of the deployment frame 502. Preferably, the containment shell actuators are mounted where the perforating assembly 508 is fixed. Deployment frame 502 and perforating assembly 508, along with containment shell 504, are arranged in a manner that allows containment system 500 to be deployed from the surface vessel 570 with a load line.

The deployment frame 502 can also be configured with location and grab arms 562 to facilitate the attachment of containment system 500 correctly onto the designated area of the conductor casing 506 or riser above the mud line. The operation of the grab arms 562 pulls the deployment frame 502 onto the conductor casing 506 so the containment shell 504 can be closed around the conductor string 506. This operation can be employed in above- or below-the-mud-line applications to secure the containment system 500 to the outer conductor casing, riser, or casing string. Referring to FIG. 5A, deployment frame 502 once positioned by the grab arms 562, frame clamps 564 can be energized to close and lock onto the outer conductor 506. Preferably, the frame is configured with one side opened to allow this action.

Once the deployment frame 502 has been properly located on and locked to the conductor casing 506, the containment shell actuators are energized to close and seal the half-shell components of the containment shell 504 around the outer conductor casing 506. Preferably, the ROVs can energize the containment shell actuators to close and seal the containment shell 504. After an adequate seal is achieved, the main fluid line (as demonstrated in FIG. 3C as line 334) running from the surface vessel can be attached to the perforating assembly 508 and the deployment frame 502 at arrangement 510. In the preferred embodiment, the main fluid line comprises high pressure small bore risers, and arrangement 510 is a stab and hinge-over arrangement. Attaching the main fluid line or HP risers line at arrangement 510 aligns the connector of the riser with the riser-interface 512 of the perforating assembly 508. Once aligned, the HP riser connector can be engaged to lock the risers to the HP riser-interface 512. In the preferred embodiment, the ROVs provide support and guidance of the HP riser line during the operation to connect the risers to perforating assembly 508. The connected HP riser line allows for the coil tubing and or kill weight fluid to be introduced into the well. The main service umbilical (not shown) providing various electrical lines, control lines, and fluid tubes can be connected to containment system 500 at the umbilical-interface 514 on deployment frame 502. In the preferred embodiment, the umbilical is configured to run through open water where additional support is not required. The main service umbilical supplies containment system 500 with at least (1) power to operate various components, (2) control and monitoring means of the riser-interface, umbilical-interface, and well control interface, and (3) cutting and sealing fluid. The monitoring means allow for monitoring of the pressure of the fluid flow within the well. The measurements provided by the monitoring means allow for determination of the velocity and pressure at which to introduce the coil tubing and/or fluid into the interior of the conduit, as discussed further below. While the main service umbilical allows containment system 500 to be self sufficient, the ROVs can be used to assist the well kill operation as necessary.

Figure 5B:
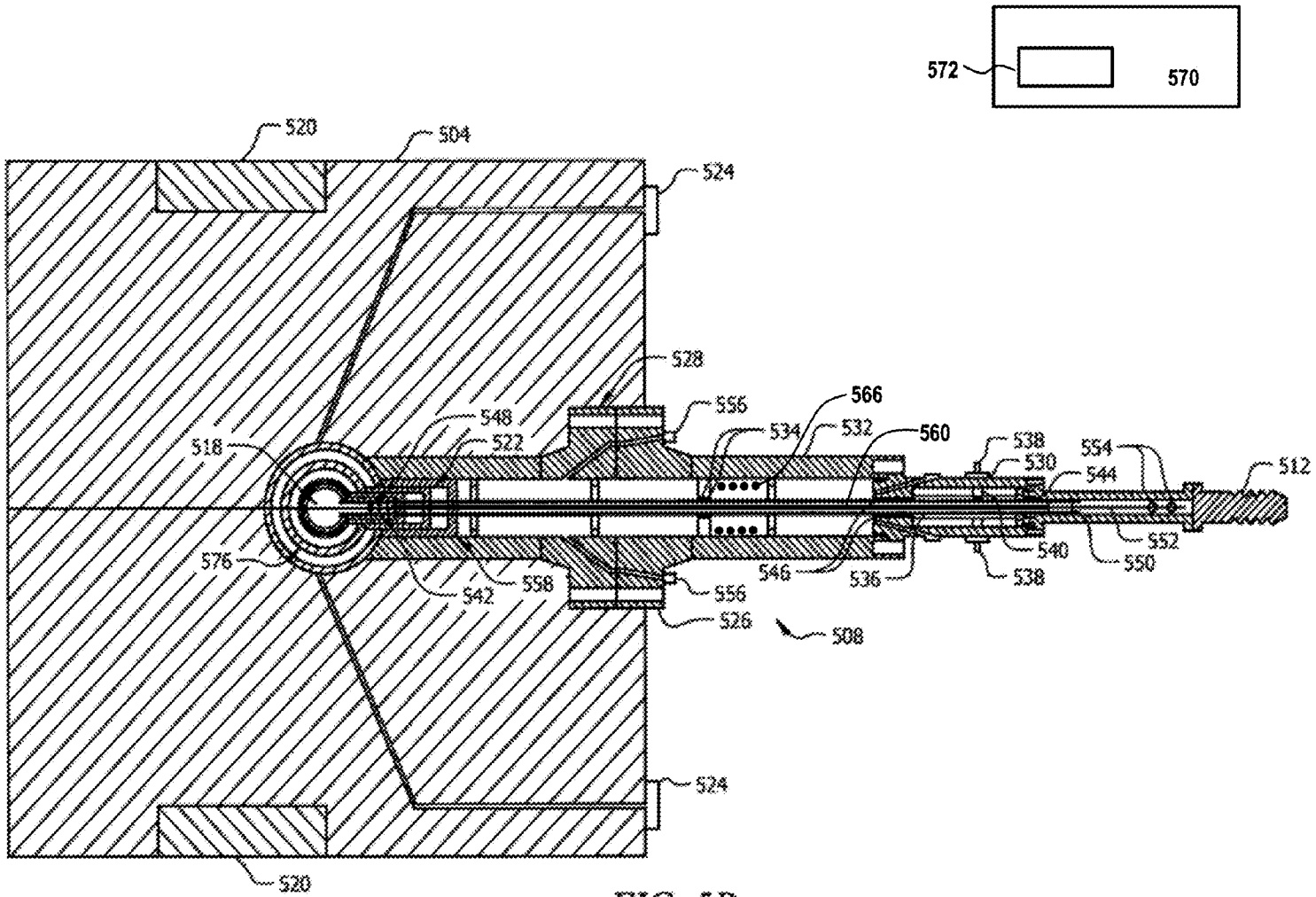
FIG. 5B shows a horizontal cross section of the second embodiment of the present invention.

Referring to FIGS. 5A and 5B, containment shell 504 has a split arrangement where the two halves are hinged together to allow the halves to enclose the outer conductor casing 506. One or more containment shell actuators can be energized to close and seal containment shell 504 to form a pressure barrier between the pressure external to containment shell 504 and the pressure inside containment shell 504. In the preferred embodiment, containment shell 504 is actuated with one or more hydraulic cylinders that provide the necessary force to engage the gripping and sealing collets onto the outer conduct casing 506. Preferably, the containment shell 504 is designed to handle and manage sealing forces required to seal up to 15,000 psi from multiple casing strings, e.g., 506, 516, and the well bore 518. In the preferred embodiment, the sealing is achieved by multiple metal and elastomeric sealing elements that are capable of attaching to sealing a wide range of surfaces and mixed diameters of the outer casing 506.

Referring to FIG. 5B, the containment shell 504 houses perforating assembly 508 that is integrated into a portion, preferably one half, of containment shell 504. Preferably contained within the containment shell 504 are ultrasonic image sensors 520 that are positioned directly across the path of the tool and conductor. Their function is to provide real time imaging of the perforating process, particularly the operations of the perforating sleeves 522. The containment shell 504 has pressure ports and sensors 524 to enable testing of the pressure of the containment shell 504 and the seal integrity between the perforating assembly head 542 and the outer conductor casing 506. Depending on the operation and the complexity of the project, the containment shell 504 can be configured to accommodate and manage multiple perforating assembly heads within a single containment shell.

Referring to FIGS. 5A and 5B, perforating assembly 508 has a perforating assembly flange 526 that allows perforating assembly 508 to connect to the containment shell 504 at an interface where the flange 526 mates with the receptacle 528 within the containment shell 504. In the preferred embodiment, flange 526 is a standard API BX high pressure flange. In certain applications, the receptacle 528 is designed to partially or completely protrude from the containment shell 504 as required. As discussed above, perforating assembly 508 is supported within the deployment frame 502, as the rear of the perforating assembly 508 is mated, at arrangement 510, to the deployment frame 502 and the main fluid line deployed from the surface vessel, such as the support vessel 338 shown in FIG. 3C.

The perforating assembly activation body 530 is connected to the perforating assembly flange 526 via a high pressure gasket ring either bolted or directly welded to the interface as the application dictates. The activation body 530 houses the main drive cylinder 532. In the preferred embodiment, the drive cylinder 532 is actuated with hydraulic pressure from the control system 572, and the hydraulic pressure enables the perforating sleeves 522 to be moved in and out of the perforating assembly 508 at the required pressure to cut into the respective casing string. Preferably, the control system 572 is located on the surface support vessel 570. In the preferred embodiment, the drive cylinder 532 has a spring return and locking system 566 so the perforating assembly 508 can be removed in the event of a power failure, or locked in place once access to the well bore is achieved.

Preferably, the drive cylinder 532 has a rotating bearing and high pressure sealing 534 to seal and isolate the central shaft 536 from the controlling hydraulics within the system. The drive motors 538 provide the necessary hydraulic drive to actuate the drive assembly 540. The drive motors 538 are connected and locked to receptacles on the perforating assembly activation body 530. In the preferred embodiment, the drive motors 538 used by the perforating assembly 508 are dual mounted hydraulic motors that can be replaced by the ROV.

The drive shaft 536 is the central component of the perforating assembly 508. The drive shaft 536 is designed to manage the estimated maximum pressures for a particular well. In particular, the drive shaft 536 provides the link from the drive motors 538, drive assembly 540, and control system 572 to the perforating assembly head 542. In the preferred embodiment, the drive shaft 536 is hollow and is constructed out of corrosion resistant alloy. The center core of the drive shaft 536 is the main fluid path and as such, it is the only route available to provide access to the well bore 518. The drive shaft 536 is designed to move within the perforating assembly 508 as a single assembly with the rotation of the drive shaft 536 being accomplished by the drive motors 538.

In the preferred embodiment, the drive shaft 536 contains pilot lines 560 that connect the hydraulic slip ring 544 with the perforating assembly head 542. The hydraulic slip ring 544 is located toward the rear and on the outside of the drive shaft 536. These pilot lines 560 provide the hydraulic control signals down the drive shaft 536 to the perforating assembly head 542 to operate the perforating sleeves 522 with no interference to the sealing surfaces 534 and 546.

Preferably, the drive shaft 536 contains an internal access valve 548, which is similar to a safety valve. The internal access valve 548 allows the operator to control access to the drive shaft center line for different operations. The internal access valve 548 is fail-safe device that will seal the drive shaft 536 and prevent any access to or leak from the casing strings or well bore 518 in the event of power failure and signal loss. The access through the drive shaft 536 is sufficiently large to allow the coil tubing to access the well bore, and it can be moved directly down the well bore ("kick off") to run into the well itself.

Referring to FIG. 5B, the drive assembly 540 connects the drive motors 538 and drive cylinders 532 to the drive shaft 536 of perforating assembly 508. Preferably, the drive assembly 540 includes twin hydraulic motors and direct shaft gear interfaces configured to rotate the drive shaft 536 clockwise or counterclockwise. Preferably, the drive motors 538 and drive assembly 540 connect to the perforating assembly 508 by bolting and sealing directly with the activation body 530. Preferably, the drive assembly 540 has dual rotating and sealing bearings 546 that isolate the drive shaft 536 from the hydraulic control systems 572 used to activate the perforating assembly for operation. In the preferred embodiment, the entire drive system, including the drive cylinder 532 and the drive assembly 540, floats on two reaction rods that are part of the drive assembly 540. This allows the drive system to move in conjunction with the drive shaft 536 when the perforating assembly 508 conducts its perforating operations.

Referring to FIG. 5A, during the operation of the perforating assembly 508, it is necessary to control and adjust the perforating assembly head 542. Referring to FIG. 5B, this is accomplished by the use of the hydraulic slip ring 544 that is connected to the drive shaft 536 and mounted in or near the drive communication and activation assembly 550. The slip ring 544 receives its signals from the control system 572 and communicates the signals to the perforating assembly head 542 via the pilot lines 560 bored along the drive shaft 536. The control signals provide instructions to the perforating head 542 to select the correct perforating sleeve 522 and to operate the internal access valve 548 at the tip of the perforating assembly 508.

Referring to FIGS. 5A and 5B, at the rear of the activation body 530 is the well access valve 552. The well access valve 552 is connected to the activation body 530 with bolts and high pressure sealing gaskets to ensure the well access valve 552 can provide pressure containment for the upper end of the perforating assembly 508. In the preferred embodiment, the well access valve 552 contains two shearing and sealing ball or gate valves. The well access valve 552 provides the only access to the central shaft 536, and along with the internal access valve 548, it provides the only access to the well bore once access to the well has been achieved.

The activation body 530 has a rotating bearing and sealing area 546 to isolate the drive assembly 540 from the well access valve 552. The drive shaft 536 is designed to move freely within the well access valve 552 during normal operations without compromising the seal integrity. The well access valve 552 terminates at the HP riser-interface 512, which can be connected to the main fluid line via the HP riser connector as discussed above. Preferably, the HP riser-interface 512 is a high pressure male connection interface.

Referring to FIGS. 5A and 5B, contained within the well access valve body 552 are the dual access valves 554. Preferably, the dual access valves 554 are either gate or ball valve configuration, and they are part of the well access valve body 552. In the preferred embodiment, the dual access valves 554 are not connected to the drive shaft 536 but, instead, they are located within the cavity of the rear of the drive shaft 536. In the preferred embodiment the dual access valves 554 have the ability to shear and seal coil tubing that is in use within the well, or they can provide a regulatory barrier between the well bore and the environment outside of the well bore. As discussed above, the dual access valves 554 allow access from the surface facility to the perforating assembly 508, and thus the well bore after the perforating operation is completed, via the connected HP riser. The HP risers used in the operations are dependent on the well construction and conditions of the environment and well kill operations.

Referring to FIGS. 5A and 5B, there are two high pressure access ports 556 located at each side of the perforating assembly 508. Preferably, both access ports 556 are protected by dual fail-safe valves to isolate the perforating assembly 508 cavity in the event of power failure. The access ports 556 allow the cutting and sealing fluid to be supplied to the perforating sleeves 522 by connecting the access ports to the activation panel (not shown) mounted to the deployment frame 502 and the service umbilical connected at umbilical-interface 514. The access ports 556 also allow sealant to be supplied to the perforating assembly so the cavities between each casing string can be filled with sealant as the perforating operation progresses.

Referring to FIGS. 5A and 5B, as discussed above, the perforating sleeves 522 are selected to match the casing strings installed at the particular well so that each sleeve matches the string used in the well construction. The perforating sleeves 522 have a perforating face at the front end, which is toward the head of the perforating assembly 508. The other end has dual sealing and locking areas 558 on the external side of the perforating sleeve.

In the preferred embodiment, each sleeve 522 is pilot drilled to allow circulation fluid to enter the sleeve 522 at the rear and flow out the front end to lubricate and flush the perforating or cutting surface. Preferably, within the sleeve 522 is an index area that allows the perforating assembly head 542 to engage and rotate either all the sleeves or just a selected sleeve. The perforating assembly 508 has the ability to actively control the perforating process by controlling the forward and backward movement of the sleeves 522, which are mounted to the perforating assembly head 542 and drive shaft 536. The forward and backward motion is controlled by the main drive hydraulic cylinder 532 and the control system 572 itself. The control system 572, located on the surface support vessel 570, calculates the correct pressure to maintain the optimum cutting force required to mill or cut through each casing string, beginning with the outer conductor casing 506. During operation, constant pressure is preferably maintained on the perforating sleeves 522 as they rotate.

There can be many different combinations of sleeves, all of which are dictated by the construction of the particular well they are being used on. The perforating sleeves 522 are used together in order to mill the desired access port in the casing string, e.g., 506, 516, that is being milled or cut through. In the preferred embodiment, the operation can be viewed via the ultrasonic imaging system 520 built into the clamp body 504. Once the desired depth and distance has been reached between the outer conductor casing 506 and the inner casing string 516, the perforating sleeve 522 is locked into place by the perforating assembly head 542. The specific sleeve 522 can then be sealed in place and pressure tested to its respective casing string, e.g., 516, and the activation body 530. The activation of the sealing compound permanently seals the particular sleeve 522 to its respective casing string, e.g., 516. After the pressure sealed is achieved, the subsequent sleeve 522 matched to the next casing string can be activated to begin the milling or cutting of that casing string.

The perforating assembly head 542 provides the necessary components that are activated by the control system 572 to connect the perforating assembly head 542 with one or more perforating sleeves 522. The perforating assembly head 542 has the ability to engage, rotate, and lock each sleeve 522. The internal access valve 548 of the perforating assembly head 542 can be operated by the control system 572 to allow cuttings to be circulated out of the perforating assembly 508 and to seal off the drive shaft for the activation of the next sleeve 522. Preferably, the internal access valve 548 is a built in flap valve. Once the perforating operation is completed and access to the well 518 is achieved, the final sleeve 522 and perforating assembly head 542 are isolated from the rest of the perforating assembly 508 by the sealing and locking area 558.

While the description and corresponding FIGS. provide embodiments where a separate vessel delivers the containment system of the present disclosure to a damaged well after other safety tools have failed, it is envisioned in other embodiments that the containment system can be deployed as a primary safety system and preinstalled within a subsea drilling well design to provide an additional safety device if all other principal methods of well control fail. Also, in addition to being used in emergency well containment and control applications, the containment system of the present disclosure can be utilized by the industry for other functions, where there is a requirement to access a well from outside the vertical plane.

As further discussed in the following paragraphs, the present disclosure provides for a method to use containment device 324 to provide prompt containment of a well in situations involving a subsea blowout, or loss of containment on subsea to surface high pressure risers or other catastrophic events that render primary and secondary well control inoperable, either due to exploded debris being in the way, the BOP being pulled off at angle, the BOP being damaged beyond repair, or loss of the surface platform. Referring to FIG. 3A, in response to such an emergency, the invention provides for the deployment of support vessel 338 to the site of the blow out, or other event to contain well 302. Preferably, support vessel 338 has the necessary equipment to access and kill the well 302, including at least fluid tanks with circulation fluid, kill weight mud fluid, and sealant fluid; coil tubing system and tools; high-pressure cement pumps; power supply; excavator 316; ROVs 328; and containment system 324 as described above. The equipment on support vessel 338 allows access to and re-entry into the well below the BOP, or a suitable access point on a riser above the mud line if applicable. As a result, the invention allows coil tubing and or kill weight fluids, or cement to be introduced directly to the wellbore and passing through the annulus areas of the casing strings.

Referring to FIG. 3A, after support vessel 338 arrives at well 302 in response to a blowout or other emergency, it deploys subsea excavator 316, if necessary, to excavate the portion of seabed immediately below BOP 304 to expose a clean portion of casing 312. In the attachment of the containment system 312 to a subsea-to-surface riser, the system will be deployed onto a clean area of the riser/casing. Typically, for a below the mud line application, the clean portion of casing 312 will begin about ten feet beneath sea floor 308. Preferably, the subsea excavator 316 exposes about thirty feet of casing 312. As described above, the exposed portion of casing 312 will typically include at least the thirty-six inch, twenty-six inch, twenty inch, thirteen and three-eighths, and the nine and five-eighths inch casing, where casing strings of decreasing sizes are placed one inside the other. The exact number and size of casing strings depend on well conditions, and whether the area of access is above or below the mud line, both of which also dictate the configurations of containment system 324. Preferably, containment system 324 is installed as close to BOP stack 304 as possible for a sub mud line operation. Otherwise, installing containment system 324 at deeper depths may affect the top support structure of the well. As casing 312, rather than seabed 308, provides the foundation for BOP stack 304, containment system 324 will place more load pressure and stress on casing 312 the deeper it is installed.

Referring to FIG. 3B, support vessel 338 deploys emergency well containment system 324 by lowering it with surface load line 326. Referring to FIGS. 3B and 5A, instead of containment system 324, support vessel 338 can also deploy containment system 500. FIG. 3B does not show all the equipment necessary to lower containment system 324, which can include an adjustable buoyancy module to facilitate this operation for mid-water operations on subsea-to-surface risers and conductors. Such deep sea operations are known in the art and available commercially to deploy containment system 324 to the necessary depth. ROVs 328 are used to guide and maneuver containment system 324 into place to be clamped around the clean section of casing 312. The containment system 324 is a split, two-piece arrangement to enable it to surround the outer casing string of casing 312 and clamp to the casing string.

Referring to FIG. 5A, the containment system 500 can be deployed without a control umbilical connected to deployment frame 502 because the ROVs will supply the power and control signals to guide and position the containment system 500. Once in the deployment frame 502 is in position, the ROVs supply the power and control to the alignment arms (not shown) of the containment shell 504 to engage the conductor casing 506 and subsequently energizes the actuators to close the two halves of containment shell 504 to around the outer conductor casing 506.

In one embodiment, the two halves of the containment shell 360 are manipulated by hydraulic operators which provide the closing and locking force to the two parts. The two parts of the containment shell 360, once energized, have collet-gripping seals that lock both hydraulically and mechanically to casing interval 312 and form a pressure barrier between the external pressure and the interior of containment system 324. The collet-gripping or packer seals, once energized, squeeze into containment system 324 to create a high integrity seal against the conductor of casing 312 and the body of containment system 324. As discussed above, other means can be employed to isolate the pressure of containment system 324. The cavity between the grippers and containment system 324 is permanently sealed by injecting a sealant, such as cement or sealing compound, to fill that any cavity between the containment shell 360 and the casing 312, thereby containing the pressure permanently. While the preferred sealant is cement or sealing compound, other commercially available sealants can also be used. The sealant is delivered by power/fluid supply line 336.

Referring to FIG. 5A, the containment shell 504 of containment system 500 can be sealed in a similar manner as described above with respect to containment system 324 to create the pressure barrier. Once the containment shell 504 has been sealed, the surface vessel can deploy main fluid line (not shown), which preferably comprises high pressure (HP) small bore risers. The HP risers can be connected to perforating assembly 508 using a HP riser connector at the riser-interface 512. In the preferred embodiment, the risers used are high pressure (HP) small bore risers. The HP risers can be deployed in short stands and can be deployed to run from the side of the vessel using the riser deployment unit or from the stern of the vessel using other means known in the art or available to be used with the particular vessel. The riser can be deployed from any conventional rig or workover vessel using existing equipment. As discussed above, the main fluid line can also be flexible and terminated at the surface vessel.

Referring to FIG. 3C, the containment shell 360 is clamped in place around the outer conductor of casing 312. Containment shell 360 provides a pressure barrier with respect to that enclosed portion but not the wellbore. The pressure within containment system 324 is tested with equipment located on support vessel 338 through power/fluid supply line 336 to ensure it is properly contained. After containment system 324 is installed on casing 312, the deployed ROVs 328 stand by as containment system 324 engages in the perforating of the outer conductor of casing 312 and initiates the sealing process. In another embodiment, the ROVs 328 can be used to provide the necessary support for the described actions above, such as operate containment system 324 locally to conduct the clamping and perforating operations and open the external port 332 to allow the introduction of coil tubing and or kill fluids into the perforating assembly 330 from the support vessel 338.

Referring to FIG. 3D, once the containment shell 360 is sealed to the outer conductor casing of casing 312, containment system 324 begins its penetrating operation with perforating assembly 330. As discussed above, for well 302, perforating assembly 330 has four sleeves, 340, 342, 344, and 346, because well 302 has four casing strings, and each perforating sleeve is customized to conform to the pressure rating of the respective casing string. Each of the perforating sleeves 340, 342, 344, and 346 is connected to the power head that is energized to mill through its respective casing string. Each perforating string is sealed to its respective casing string thereby, effecting a seal between the casing string and its annulus area. The pressure and seal of each perforating string is tested to ensure proper pressure containment before perforating of the next casing string begins.

While perforating operations is preferably driven by redundant hydraulic motors, other types of motors can be used. As mentioned above, the casing information, e.g., number and size, of a particular well can be obtained from its well log, drilling program procedures, or the well design data. Accordingly, containment system 324 is deployed with perforating sleeves that have been configured to match the number, size, and pressure rating of the well to be contained. Specifically, there is a difference in the pressure rating of the conductor casing strings. As mentioned above, the thirty-six inch and twenty-six inch conductors provide structural support while pressure containment is achieved with the twenty inch casing. This creates a difference in the pressure rating between the structure casing strings (e.g., thirty-six inch and twenty-six inch) and the pressure containment casing strings (e.g., twenty inch). Due to this pressure difference, it is crucial that each casing string is penetrated with a sleeve that provides the same pressure rating as it extends between a first and a second casing string through the cement encased annulus barrier. That is, the sleeves act as mini casing strings and sealing them maintain the pressure rated conduit through both the pressure casing strings and structure casing strings. Also, during perforating operations, lubricating fluids can be introduced from support vessel 338 via power/fluid supply line 336 to perforating assembly 330 through external port 332.

Referring to FIG. 3D, perforating of the outer conductor of casing interval 312 begins with the first and largest pre-sized perforating sleeve 340. The sleeves are connected to a power head that can energize and seal each sleeve as it mills/cuts through its particular casing. Sleeve 340 is energized to drill through the first conductor casing and is extended to just before the second conductor casing. Because the distance between the casing is known from well log information, the placement of sleeve 340 next to the second conductor casing can be determined. Sealing material, such as cement or sealing compound, is injected to attach and seal perforating sleeve 340 to casing interval 312. The injected sealant is represented by numeral 348. The sealing of perforating sleeve 340 with the sealant effectively creates a bridge between the first and second conductor casing strings. This bridge can be pressure tested to ensure it has the same pressure rating as the first conductor casing. Also, the sealing of perforating sleeve 340 forms a containment area between containment system 324, the first conductor casing, e.g., the thirty-six inch conductor, and the second conductor casing, e.g., the twenty-six inch conductor.

Referring again to FIG. 3D, after the bridge between the first and second conductor casing has been tested, the next cutting string, perforating sleeve 342, is now energized to cut through the second conductor casing. Perforating sleeve 342 is also placed adjacent to the third conductor casing, e.g., the twenty inch conductor, to be similarly sealed with sealing material injected from power/fluid supply line 336 to create a second bridge between the second (e.g., the twenty-six inch) and third (e.g., the twenty-inch) conductor casing. The process of perforating and then sealing is repeated as many times as necessary until the live well is reached. That is, the next pre-sized cutting string, e.g., perforating sleeve 344, is energized and sealant is injected between the casing strings until the last tool used is the one that will breach the production liner 362. Each perforating sleeve is set into the top of the perforating assembly 330 in a nested configuration, where each sleeve is isolated by high integrity locking seals, and the last sleeve has access to the dual barrier port 332. By containing the pressure one casing string at a time, the present invention allows for access to a live well without compromising the structure of the well.

Referring to FIGS. 5A and 5B, the perforating sleeves 522 located at the perforating assembly head 542 are operated in a similar manner as described above with respect to perforating assembly 330. That is, each sleeve 522 is configured to match the specifications, e.g., pressure, of its respective string, e.g. 506, 516, and the sleeve is attached and sealed to its respective casing before the subsequent sleeve is activated. FIGS. 5A and 5B show the completion of the perforating operations with each sleeve 522 attached and sealed to its casing and access to the well bore 518 is achieved.

In other embodiments, it is envisioned that the casing strings of casing 312 were manufactured to have an access point for installation of containment system 324 already built in to facilitate the operations of containment system 324, thereby potentially cutting the time to contain a blowout or other uncontrolled flow in half.

Referring again to FIG. 3D, perforating sleeve 346 penetrates production liner 362 of wellbore 310 and enters the flow of reservoir fluid. Further, perforating sleeve 346 is capable of introducing coil tubing and or kill weight fluids and cement to establish control of the well and introducing a cement plug. In other embodiments, the use of a rigid main fluid line 334 allows containment system 324 to introduce coil tubing into the wellbore to deploy plugs or other devices to facilitate well control. The final perforating sleeve 346 can be configured to intersect any drill pipe that may still be located within the active wellbore. As discussed above, kill weight fluid, such as mud, is injected into a wellbore to introduce sufficient hydrostatic head to stop the flow of hydrocarbon up such wellbore. The specific composition of the kill weight fluid is known in the art and usually depends on the conditions of a particular well. After production liner 362 is breached and before any kill weight fluid can be introduced, the flow pressure of well 302 must be monitored to determine the necessary parameters at which to inject the kill weight fluid to contain the well. The calculated parameters include at least the velocity of the kill weight fluid being introduced by the pump, the weight of the mud used for the kill weight fluid, and the pressure the pump must deliver at the point of entry into wellbore 310 to start the killing process. The calculation of these parameters also need to consider the entry angle of the kill weight fluid. While FIGS. 3D and 3E show perforating assembly 330 and entry angle of the kill weight fluid at approximately a 45 degree angle, the entry angle in other embodiments can be at any angle. Preferably, the entry angle will be optimized for the particular well, depending on the density and flow pressure of that well and the potential for introduction of coil tubing.

Once the parameters are determined and programmed, the ball or gate valves of external port 332 are opened to begin introducing the coil tubing and or kill weight fluid. The coil tubing can also be used to set plugs or other tools, to halt the flow of the well and introduce tubing down the well to inject kill weight fluids at depth. The pressure at which the kill weight fluid is introduced is much higher than the pressure of the flow of hydrocarbon out of well 302. Initially, the injection of the kill weight fluid will create a substantial amount of turbulence, which helps break the flow of fluid within the wellbore. Referring to FIG. 3E, the flow of hydrocarbon, represented by arrows 350 has slowed and been displaced. As more kill weight fluid is being pumped into wellbore 310, the more weight is placed upon the column. This is called "bull heading" the flow of well 302. When sufficient kill weight fluid is introduced, the hydrocarbon and reservoir fluids are driven back down well 302. Once the pressure of well 302 has been balanced, the reservoir will stop flowing due to the hydrostatic head created by the injected kill weight fluid. To maintain this balance permanently, cement is introduced to create a cement plug that permanently seals well 302. Once well 302 is sealed, the cement plug is pressure tested to ensure it is properly bonded to the wellbore and respective casing strings.

Referring to FIGS. 5A and 5B, the kill fluid is similarly introduced from the surface to well bore 518 through the connected main fluid line (not shown) into the drive shaft 536 of the perforating assembly 508 and finally into the well bore 518. The specific composition of the kill weight fluid, the quantity of the fluid, and the rate at which the fluid is pumped into the well bore 518 can be calculated as described above with respect to containment system 324. The type and size of risers used can also play a factor into the calculation.

In other embodiments, containment system 324 has the capability to allow small bore coil tubing to be utilized for additional well control operations. The coiled tubing is deployed within the main fluid line 334 from the support vessel 338. In this embodiment, dual barrier external port 332 is capable of shearing the coiled tubing when necessary. Also, support vessel 338 would be able to accommodate the coiled tubing system. Typically, coiled tubing is used in certain situations because fluids can be pumped through the coiled tubing. Another benefit is that it can be pushed into a well rather than relying on gravity. The coil tubing can be utilized to introduce specific tubing plugs which can be used to further enhance the capabilities of containment system 324 to control different types of well blowouts or other loss of primary well containment. Referring to FIGS. 5A and 5B, containment system 500 also has the capability to accommodate coil tubing where the drive shaft 536 is sufficiently large to allow the coil tubing to access the well bore 518 and dual well access valves 554 have the capability to shear and seal coil tubing that is in use in the well bore 518.

FIG. 3F shows the well plugged with cement column 352, and containment system 324 sealed and capped. After it is sealed and capped, containment system 324 becomes part of abandoned well 302. Subsea excavator 316 (shown in FIG. 3A) can be used to fill in the excavation. After the equipment from support vessel 338 (shown in FIGS. 3A-3C) is retrieved, the damaged BOP and associated rig equipment are now accessible and can be recovered. The standard procedure for abandoning a well can be initiated as normal. Referring to FIGS. 5A and 5B, the containment system 500 can be similarly sealed and capped so that it becomes part of the well to be abandoned.

The present disclosure provides detailed descriptions of the various embodiments of the present invention for controlling a blown-out subsea well, and other events where the loss of primary and secondary well control and other safety systems result in a catastrophic release of hydrocarbons into the environment. While the present invention has been described with respect to one of its preferred applications and parallels drawn to other embodiments, it is envisioned that the present invention can be employed in other applications. For example, this invention can also be applied to contain similar uncontrollable flow of hydrocarbons into the environment from subsea production and injection wells that have lost all production containment and have structurally compromised production systems. It can also be applied to access wells from damaged surface facilities where HP risers carry hydrocarbons from subsea wellheads to surface production or drilling equipment. In such a situation, the invention can be deployed in a similar manner onto a production or water injection well. Subsequently, the production bore can be accessed to introduce direct well control devices, or fluids to reestablish control of the well. In this embodiment, it is assumed that the sub-surface safety valves have failed to operate as designed, i.e., the closure of the valve in event of loss of signal from the production control system, either local or remote. Further, in other embodiments, the invention can be employed to provide a means of conducting a regular hot tap to an existing pipeline or similar conductor located in deeper water depths, utilizing the procedures detailed above.

Also, the embodiments of the present disclosure may be used in a diagnostic manner to determine the statistics of a well that may not be damaged. In particular, the embodiments of the present disclosure allows for access to the well at any point and/or depth without compromising the integrity of the well and provide. As such, the pressure of the fluid flow within the well may be monitored at any point. The measurements provided by the monitoring means allow for determination of whether the well is operating within standard conditions, and if not, they allow any necessary remedial action to be taken to secure the wells overall pressure integrity.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A method for accessing and controlling fluid flow through a subsea well conduit above or below the sea floor, comprising the steps of:

deploying a containment system having a containment shell to a conduit comprising at least two pipes, wherein said containment system is housed within a deployment frame;

enclosing at least a portion of said conduit with said containment system; wherein said conduit is located above or below the sea floor;

sealing said containment shell about said conduit to form a pressure barrier between the pressure external to said containment shell and the pressure of the interior of said containment shell;

engaging a first pipe of said conduit with a first sleeve of a penetration device that is part of said containment system;

penetrating said first pipe of said conduit with said first sleeve;

extending said first sleeve between said first pipe and a second pipe positioned within said first pipe;

attaching said first sleeve to said first pipe; and creating a pressure seal between said first sleeve and said first pipe.

2. The method of claim 1, wherein said deploying step is performed with a surface load line or one or more remote-operated vehicles.

3. The method of claim 1, wherein said deployment frame is supported by a means for skidding said containment system into a final location without using load lines.

4. The method of claim 1, wherein said deployment frame further comprises grab arms configured to at least partly perform said enclosing step.

5. A system for accessing and controlling fluid flow through a subsea well conduit above or below the sea floor, comprising:

a containment shell configured to enclose at least a portion of a conduit comprising at least two pipes, wherein said conduit is located above or below the sea floor and is experiencing uncontrolled fluid flow through said conduit;

a deployment frame configured to house said containment shell to deploy said containment shell to said conduit;

a first fluid line to deliver sealant to said containment shell to form a pressure barrier between the pressure external to said containment shell and the pressure of the interior of said containment shell;

a penetration device configured to penetrate a first pipe of said conduit, wherein said penetration device comprises a first sleeve configured to mechanically cut through said first pipe;

sealing means to attach said first sleeve to said conduit, wherein said first sleeve extends between said first pipe and a second pipe and at least a portion of said second pipe is within said first pipe; and a second fluid line configured to introduce a fluid through said penetration device into the interior of said conduit sufficient to control said fluid flow.

6. The system of claim 5, wherein said deployment frame further comprises grab arms configured to facilitate enclosement of said containment shell onto said conduit.

7. The system of claim 5, wherein said deployment frame further comprises frame clamps.

8. The system of claim 7, wherein said frame clamps are configured to be energized to close and lock onto said conduit.

9. The system of claim 5, wherein said containment shell further comprises containment shell actuators configured to be energized to seal said containment shell around said conduit.

10. The system of claim 5, wherein said penetration device is fixed at or around a center on said deployment frame.

11. The system of claim 5, wherein said containment shell further comprises ultrasonic image sensors.

12. The system of claim 5, wherein said containment shell further comprises pressure ports and sensors.

13. The system of claim 5, wherein said penetration device further comprises a flange and said containment shell further comprises a receptacle.

14. The system of claim 13, wherein said flange and said receptacle are configured to mate to connect said penetration device and said containment shell.

15. The system of claim 14, wherein said flange and said receptacle mate within said containment shell.

16. The system of claim 5, wherein said penetration device further comprises an activation body connected to said flange by a high pressure gasket ring;

a main drive cylinder housed within said activation body;

a central drive shaft; and a penetrating assembly head.

17. The system of claim 16, wherein said main drive cylinder further comprises a spring return and locking system.

18. The system of claim 16, wherein said central drive shaft further comprises an internal access valve.

19. The system of claim 16, wherein said central drive shaft further comprises pilot lines configured to connect a hydraulic slip ring with said penetrating assembly head.

20. The system of claim 16, wherein said activation body further comprises a well access valve.

21. The system of claim 16 further comprising a control system;

drive motors; and a drive assembly configured to connect said drive motors and said main drive cylinder to said central drive shaft.

22. The system of claim 21, wherein said main drive cylinder is actuated with hydraulic pressure from said control system such that said first sleeve is moved in and out of said penetration device to cut through said first pipe.

23. The system of claim 5, wherein said penetrating device further comprises one or more access ports, wherein said one or more access ports are configured to allow said sealant to be supplied to said first sleeve.

* * * * *